US006537009B1

(12) United States Patent
Le Lan et al.

(10) Patent No.: US 6,537,009 B1
(45) Date of Patent: Mar. 25, 2003

(54) HANDLER FOR CONTAINER SHIP

(75) Inventors: Jean-Yves Le Lan, Ploemeur (FR); Olivier De Smirnoff, Port Louis (FR); Daniel Person, Coueron (FR); Gilles Christian Fournier, Issy-les-Moulineaux (FR)

(73) Assignee: Etat Francais Represente Delegation Generale pour l'Armement - DCN, Armees (FR)

( * ) Notice: Subject to any disclaimer, the term of this patent is extended or adjusted under 35 U.S.C. 154(b) by 0 days.

(21) Appl. No.: 09/202,985

(22) PCT Filed: Apr. 27, 1998

(86) PCT No.: PCT/FR98/00841

§ 371 (c)(1),
(2), (4) Date: Feb. 1, 1999

(87) PCT Pub. No.: WO98/49053

PCT Pub. Date: Nov. 5, 1998

(30) Foreign Application Priority Data

Apr. 29, 1997 (FR) ..... 97 05251

(51) Int. Cl.[7] ..... B63B 27/14
(52) U.S. Cl. ..... 414/139.4; 212/307
(58) Field of Search ..... 212/307, 325; 114/72; 14/71.1, 71.5, 71.7; 414/139.4, 139.9, 139.3, 137.1–141.7, 34

(56) References Cited

U.S. PATENT DOCUMENTS

| | | | | | |
|---|---|---|---|---|---|
| 67,031 | A | * | 7/1867 | Des Corats | 414/138.7 |
| 683,246 | A | * | 9/1901 | Campbell | 212/325 |
| 773,194 | A | * | 10/1904 | Campbell | 414/137.9 |
| 1,921,605 | A | * | 8/1933 | Canfield | 214/38 |
| 2,512,798 | A | * | 6/1950 | Hodges | 214/83.12 |
| 2,984,367 | A | * | 5/1961 | McIntyre | 212/325 |
| 3,034,659 | A | * | 5/1962 | Willison et al. | 212/325 |
| 3,091,188 | A | * | 5/1963 | Graham | 414/139.9 |
| 3,483,838 | A | * | 12/1969 | Rath | 114/60 |
| 3,591,023 | A | | 7/1971 | Allen | |
| 3,726,425 | A | * | 4/1973 | Terho et al. | 214/621 |
| 3,820,664 | A | * | 6/1974 | Lewis et al. | 214/14 |
| 3,846,860 | A | * | 11/1974 | Kummerman | 414/139.9 |
| 4,002,135 | A | * | 1/1977 | Tornqvist | 114/72 |
| 4,043,285 | A | | 8/1977 | Nordstrom | |
| 4,158,416 | A | | 6/1979 | Podesta | |
| 4,175,908 | A | * | 11/1979 | Andersson | 414/141.3 |
| 4,488,503 | A | * | 12/1984 | Galatis | 114/260 |
| 4,666,357 | A | * | 5/1987 | Babbi | 414/138 |
| 5,342,159 | A | * | 8/1994 | Warren et al. | 414/339 |
| 5,520,135 | A | * | 5/1996 | Rolland et al. | 114/254 |
| 5,618,148 | A | * | 4/1997 | Iversen et al. | 414/139.9 |
| 5,803,523 | A | * | 9/1998 | Clark et al. | 296/26.1 |
| 5,813,071 | A | * | 9/1998 | Breslin et al. | 14/71.1 |

FOREIGN PATENT DOCUMENTS

| | | | | |
|---|---|---|---|---|
| FR | 1394747 | * | 3/1965 | 414/139.4 |
| JP | 58-168734 | * | 10/1983 | |
| JP | 9388 | * | 1/1986 | 414/140.3 |
| SU | 647175 | * | 2/1979 | 414/139.4 |
| SU | 1008120 | * | 4/1983 | 414/139.4 |

* cited by examiner

*Primary Examiner*—Thomas J. Brahan
(74) *Attorney, Agent, or Firm*—Oliff & Berridge, PLC

(57) ABSTRACT

A container ship includes a hull, propulsion device, support, guide disposed on the support that is extendible beyond the hull, and handler movable along the guide. Thus, the container ship enables containers to be unloaded near a variety of points of use, i.e., not only in ports that are not equipped with port handling facilities, but also onto unequipped beaches, banks, or landing slips. The container ship also unloads containers in such a manner that it has practically no effect on the equilibrium of the ship, whatever its size.

12 Claims, 5 Drawing Sheets

HANDLER FOR CONTAINER SHIP

BACKGROUND OF THE INVENTION

1. Field of the Invention

The invention relates to facilities on board ships for loading and unloading cargo, and in particular to a container ship of the type having one hull, a propulsion mechanism, and a handler that is movable along a guide disposed on a support.

2. Description of Related Art

At the present time there are three categories of container ships:

1) container ships that have no on-board handler, from which containers can only be unloaded in a port equipped with dock cranes,
2) container ships that have a container-handler such as cranes, traveling cranes, or portal cranes and that are able, entirely autonomously, to unload containers onto the dock of a port, and
3) container ships that have a handler that moves containers to a deck with which a ramp is associated, and from which a port transport device, such as a truck or rail car, unloads one or more containers via the ramp.

Ships in the third category are described in U.S. Pat. Nos. 4,158,416 and 3,591,023. These ships have either a movable bow or a movable stem, and thus need safety devices to ensure both closure and leak-tightness.

Ships in the second category are described in U.S. Pat. No. 4,043,285, which each have a hull and a framework that is integral with the hull. The framework includes vertical, lengthwise, and crosswise beams. The lengthwise beams have rails that support an overhead crane, and project beyond the stem of the hull. This projection, which is designed to overhang the dock of a port, enables the containers to be deposited directly onto the dock with the aid of the overhead crane.

Such an unloading device has the disadvantage of being only usable on large, high-tonnage ships on which movement of the container has little effect. However, this type of ship can only moor in deep-water ports, and the containers cannot be unloaded onto an unequipped beach, bank, or landing slip. Moreover, loading and unloading cannot be continuous where the rise and fall of the tide is substantial.

SUMMARY OF THE INVENTION

It is therefore an object of the invention to overcome these problems by providing a container ship that enables containers to be unloaded near a variety of points of use, i.e., not only in ports that are not equipped with port handling facilities but also onto unequipped beaches, banks, or landing slips. It is also an object of the invention to unload these containers, and to particularly place them on the ground. It is a further object of the invention to unload containers in such a manner that it has practically no effect on the equilibrium of the ship, whatever its size.

These objects are achieved by providing a container ship of the type having a hull, a propulsion mechanism, and a handler that moves along a guide disposed on a support, wherein the guide is extendible beyond the hull of the ship.

In accordance with one aspect of the invention, the support includes at least one beam attached to the hull, that supports a first part of the guide of the handler, and that has a lengthwise cavity, inside of which is disposed a second, movable beam that supports a second part of the guide. The second part of the guide constitutes an extension of the first part when the movable beam is deployed beyond the ship's hull.

In accordance with another aspect of the invention, the support includes at least two beams attached to the hull inside which are disposed one movable beam, at least one cross beam, or a plate connecting the at least two movable beams.

BRIEF DESCRIPTION OF THE DRAWINGS

Other advantages and characteristics of the invention will appear in the description of several embodiments of the invention with reference to the attached figures, wherein.

DETAILED DESCRIPTION OF THE PREFERRED EMBODIMENTS

Figure 1:
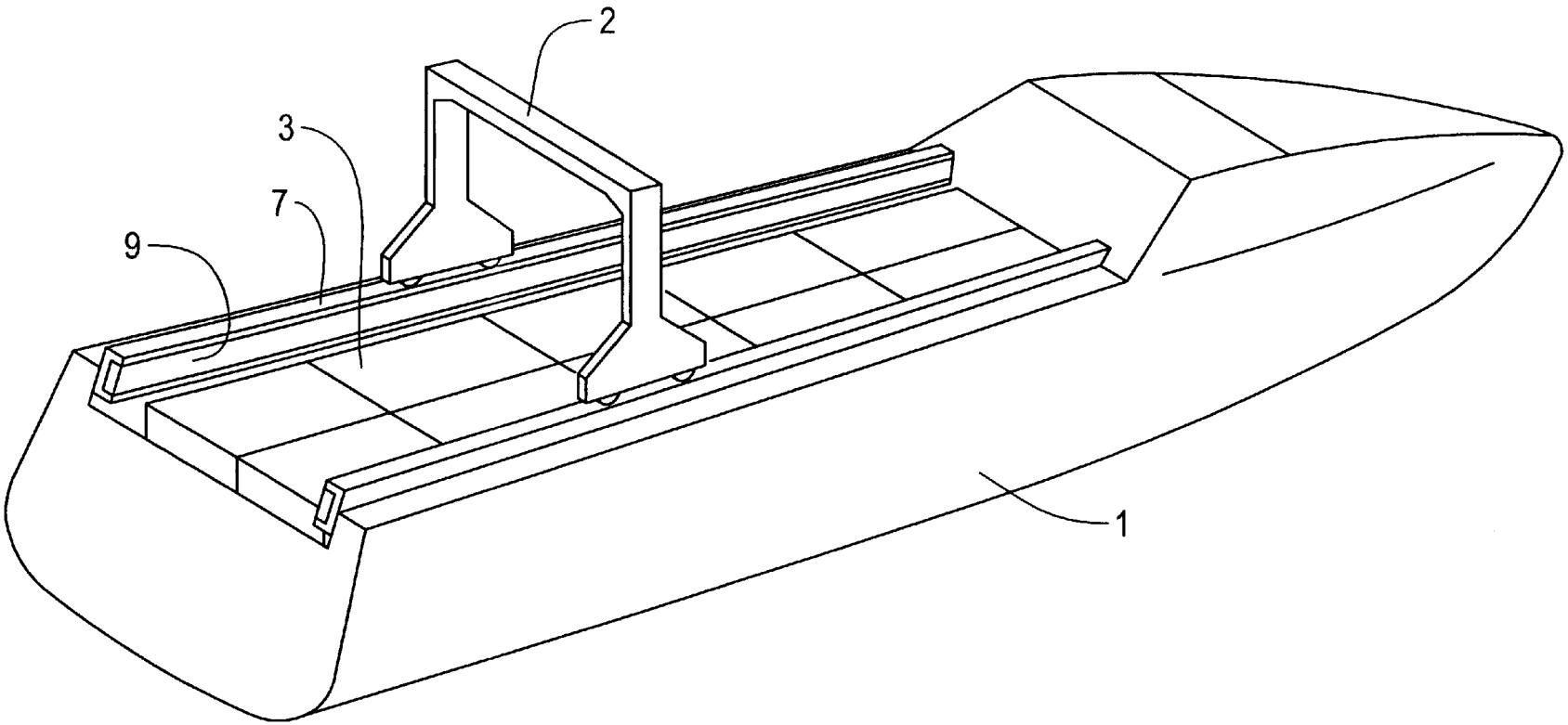
FIG. 1 is a general diagram of a container ship according to the invention.

FIG. 1 shows a ship according to the invention. It has a hull 1, propulsion and electric power supply mechanism (not shown), handlers 2 that handle containers 3, and devices that balance the ship (not shown), which can be of the weight-transfer type.

The hull is in the shape of a V in front, and a W, i.e. a catamaran, at the rear. For a given internal storage volume and a given stored weight, this shape allows the draft to be shallower than that of a single-hulled ship, while enhancing stability.

This shallow draft and this stability, both of which can be obtained with ships of the catamaran or landing type, are used in the framework of the invention to travel through shallow channels, and improve the stability of the ship both at sea and when the containers are being handled as they are loaded or unloaded.

The loaded draft of these types of ships or, more precisely, of these hulls, is less than 4 meters and preferably the ratio between their length and width is between 3 and 5.

Figure 2:
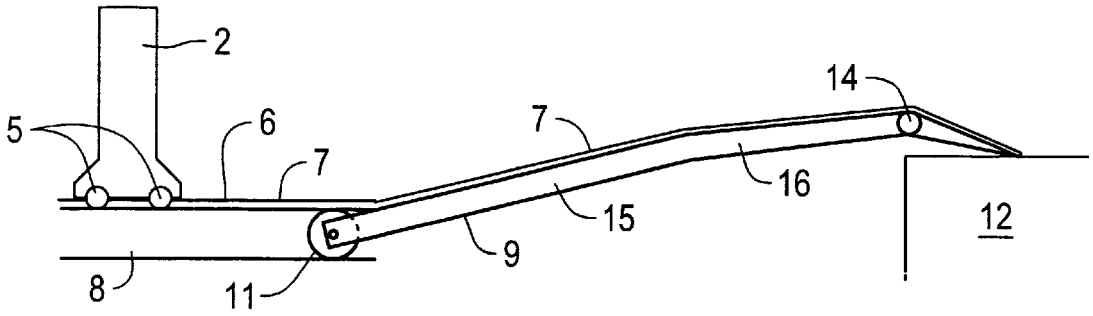
FIG. 2 is a cross sectional view taken through a guide and support of a handler according to the invention.
Figure 3A:
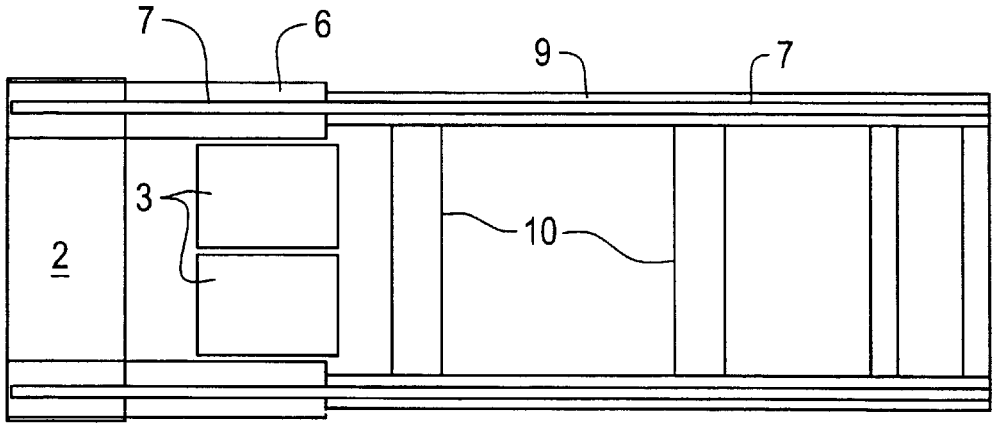
FIGS. 3*a* and 3*b* are two variants of a top view of the guide and support of the handler according to the invention.
Figure 3B:
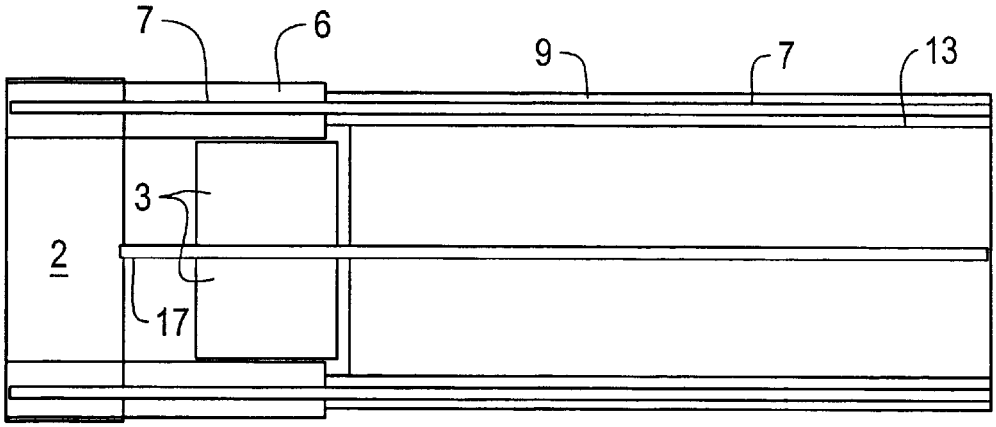

The container handler 2 is shown in FIG. 2. These handlers have a U-shaped portal crane 2, each of whose ends has wheels 5 that are designed to roll on a track that includes two beams 6 disposed lengthwise on the ship and integral with the hull. Each of the beams 6 has a rail 7 on its upper surface. The presence of wheels 5 enables the portal crane 2 to move lengthwise and translationally.

The cross-section of each of the lengthwise beams 6 is in the shape of a C, and thus defines a cavity 8. Second lengthwise beams 9 are connected by cross beams 10, and are disposed inside the cavities 8. The second lengthwise beams 9 are freely movable translationally lengthwise inside the cavities 8. To facilitate their movement, each of the second lengthwise beams 9 has a wheel 11 at one of its ends.

The portal crane 2 has a hoist (not shown) to handle containers 3. The portal crane 2 is moved electrically. As in conventional cranes, electric motors are associated with wheels 5, and electric power is supplied from on board.

In one embodiment, the cross beams 10 are replaced with a plate 13. The plate 13 has a dual function: protecting the containers when the second lengthwise beams 9 are inside the cavities 8; and serving as an access ramp for pedestrians when the beams are deployed externally.

Advantageously, a rigid, detachable element 17 is provided to connect the portal crane 2 and the assembly that includes the lengthwise beams 9 and cross beams 10 or plate 13. This rigid link enables the entire assembly to be deployed with the aid of the portal crane 2, whereby the assembly does not require its own driving mechanism. On the other hand, the device may include a mechanism that locks this assembly translationally, for example by keying. Locking also enables the second lengthwise beams 9 to be oriented vertically. Moreover, to facilitate the orientation of these beams, element 17 may be telescopic or include an actuator, for example.

As shown in FIG. 2 of this embodiment, second lengthwise beams 9 are not rectilinear, and instead have an articulation 14 near the end opposite wheel 11. The second lengthwise beams also include two continuous parts 15, 16 that define an angle of about 10 degrees between each other. When containers 3 are unloaded onto a dock 12, which is higher than the lengthwise beams 6, this angle between parts 15, 16 enables the vertical distance separating the dock from part 16 to be reduced.

It may be noted that, because of the substantially fixed positions of the ends of the second lengthwise beams 9 located on the ground, they damp the movements of the ship, thus facilitating unloading.

Figure 4:
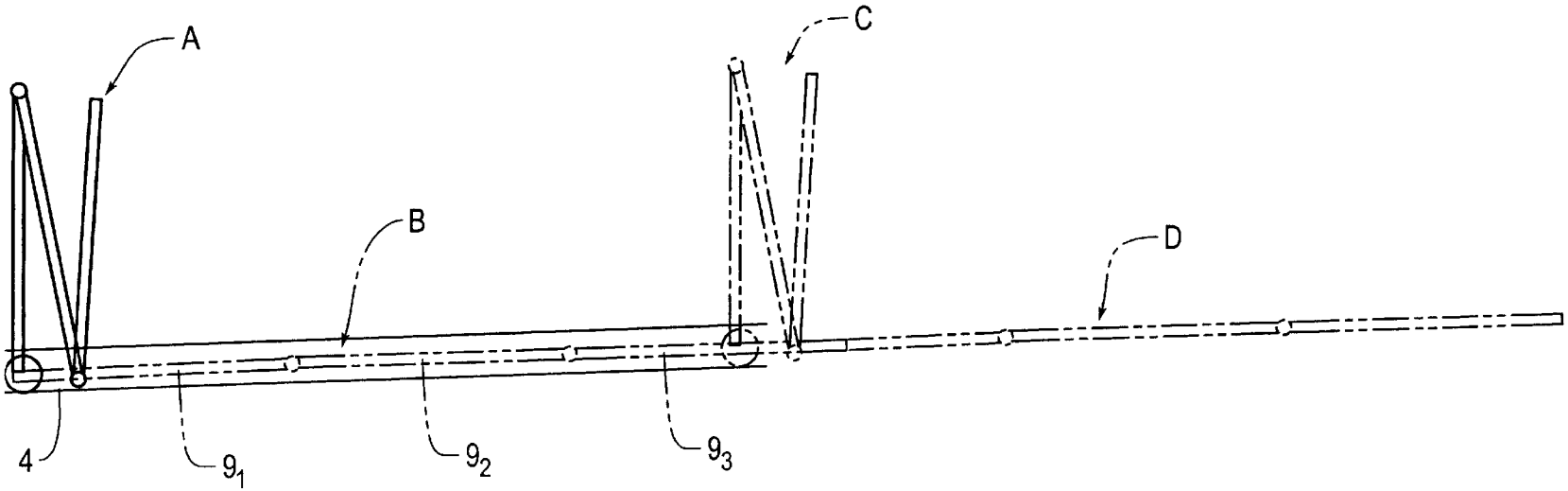
FIG. 4 is another embodiment of the guide and support according to the invention.
Figure 5:
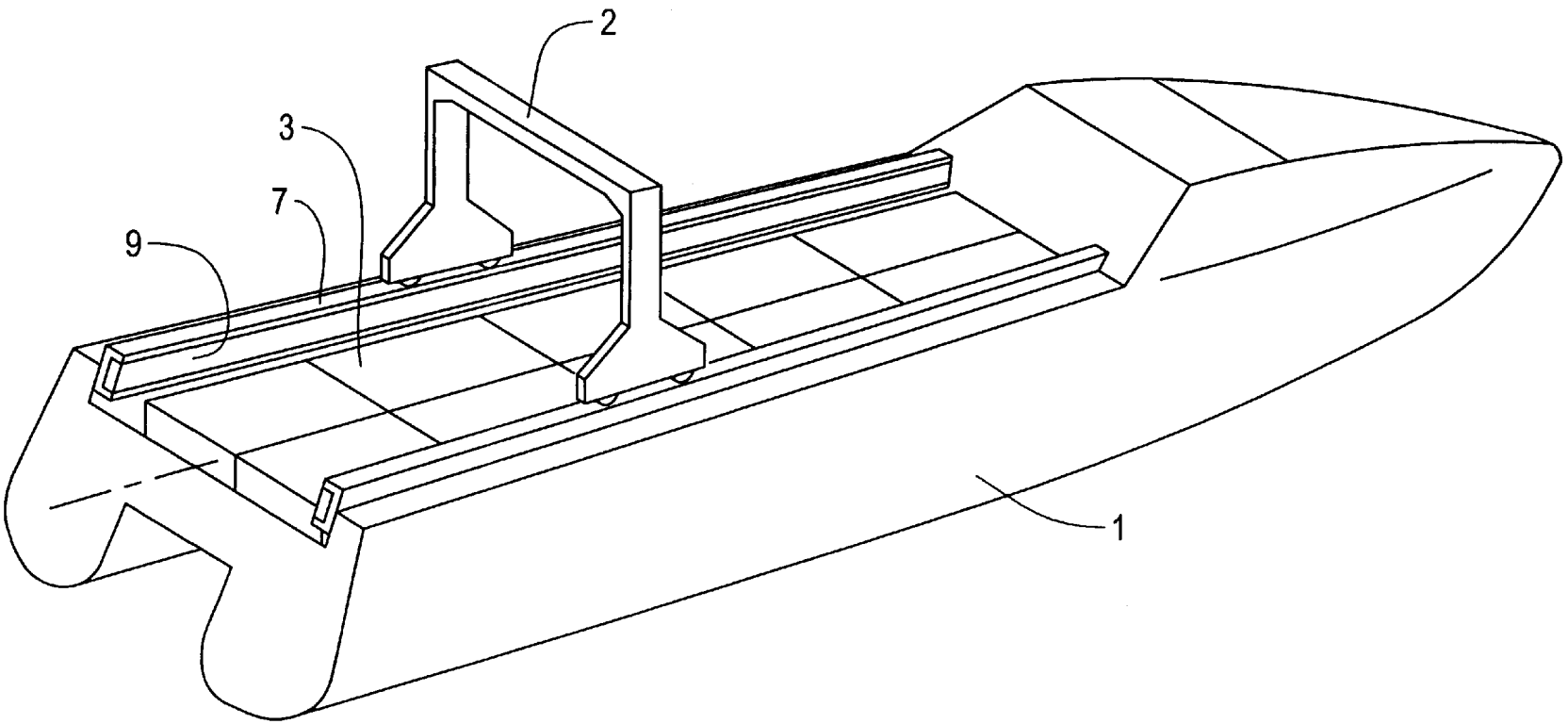
FIG. 5 is a general diagram of a container ship according to the invention similar to FIG. 1 discussed above, but showing the container ship with a catamaran hull.

As shown in FIG. 4, the movable second lengthwise beams 9 can be flexible and made of several parts $9_1$, $9_2$, $9_3$ that are articulated with each other. When the beam 9 is folded, this design affords access to the entire storage area of containers 3, because cross beams 10 or plates 13 do not overhang this area. FIG. 4 shows four different positions, A, B, C, D, of the movable beams. In two of the positions, i.e., A and C, the beams are folded at each end of the storage area. In the other two positions, i.e., B and D, the beams are deployed, with the first positions serving to protect against adverse influences from the marine environment in the case where plates 13 are used and the other as guide means.

The invention enables the guide means to be extended by a length of two to three times that of a conventional ramp, which is essential for loading and unloading containers onto a beach.

Moreover, the extension length of the guide means is adjustable so that it can be adapted as well as possible to the environment.

Of course, numerous modifications may be made to the embodiment described above without departing from the scope of the invention. Containers may be unloaded from the front of the ship or laterally, and thus the support and guide means will then be disposed differently as a consequence.

Moreover, the handler may include any device whose movement requires the presence of a guide and have an autonomous power source facilitating handling on land.

In addition, the covering of the containers may include foldable plates that are independent from beams 9 and 10.

What is claimed is:

1. A container ship comprising a hull, propulsion means and a handler for handling containers and placed on a support, a guide, for the handler, disposed on the support, the guide comprising two parallel rails each having a first part and a second part, the handler including a portal crane that travels along the two parallel rails, wherein the support includes:

two first C-shaped beams placed lengthwise on the ship and attached to the hull and disposed at opposite sides of the hull, each of the first C-shaped beams defining a cavity and supporting the first part of one of the two parallel rails of the guide, the two first beams substantially placed so as to not extend beyond the hull, two second beams disposed lengthwise, one being telescopically slidable within the cavity of one of the two first beams so as to be extendible beyond the hull and the other telescopically slidable inside the cavity of the other of the two first beams so as to be extendible beyond the hull, each of the two second beams supporting the second part of one of the two parallel rails of the guide which constitutes an extension of the first part of the parallel rails of the guide when the second beam extends beyond the hull, a continuity of travel existing for the handler between the first part of the parallel rails of the guide and the second part of the parallel rails of the guide when the second beam extends beyond the hull in that each of the parallel rails of the guide is substantially continuous in the lengthwise direction over substantially an entire length of the first beam and the second beam together, the second beams able to bear the weight of the container and the handler.

2. The container ship according to claim 1, wherein each second beam includes first and second continuous rectilinear parts, an angle being formed between the first and second continuous rectilinear parts so as to reduce a vertical distance separating a dock from an end of the second continuous rectilinear part when the dock is higher than the first part of the guide.

3. The container ship according to claim 1, wherein each second beam includes a deployed end and an articulation adjacent to the deployed end.

4. The container ship according to claim 1, further including a rigid movable element that connects the handler with at least one of the guide and an assembly integral with the guide, such that displacement of the handler causes displacement of the second part of the guide.

5. The container ship according to claim 1, wherein the hull includes a front and a rear, the front of the hull being V-shaped, and the rear of the hull being W-shaped.

6. The container ship according to claim 1, wherein the hull is of a catamaran at a rear portion.

7. The container ship according to claim 1, wherein the hull is of a landing ship.

8. The container ship according to claim 1, wherein a ratio between a length and width of the hull is between 3 and 5.

9. The container ship according to claim 1, wherein the second beams are connected by one cross beam.

10. The container ship according to claim 1, wherein the handler is separate from the container but includes a hoist for attaching the container thereto.

11. The container ship according to claim 1, wherein the handler includes a motor associated with the wheels thereof to provide power for moving the wheels of the handler along the guide.

12. The container ship according to claim 1, wherein the first part of the guide is disposed on a top surface of the first beam and the second part of the guide is disposed on a top surface of the second beam to guide the travel of the wheels of the handler along the guide.

* * * * *